United States Patent [19]

Robinson et al.

[11] Patent Number: 4,582,269

[45] Date of Patent: Apr. 15, 1986

[54] PACKAGE MOUNTING ARRANGEMENT IN A TEXTILE MACHINE

[75] Inventors: Anthony J. Robinson, Congleton; Philip M. Wilkinson, Cheadle, both of United Kingdom

[73] Assignee: Rieter-Scragg Limited, Cheshire, United Kingdom

[21] Appl. No.: 615,758

[22] Filed: May 31, 1984

[30] Foreign Application Priority Data

Jun. 11, 1983 [GB] United Kingdom ..... 8316024

[51] Int. Cl.[4] ..... B65H 54/42; B65H 54/54

[52] U.S. Cl. ..... 242/18 DD; 242/129.51

[58] Field of Search ..... 242/18 DD, 35.5 R, 43.1, 242/129.51

[56] References Cited

U.S. PATENT DOCUMENTS

| | | | |
|---|---|---|---|
| 1,517,279 | 12/1924 | Colman | 242/18 DD |
| 2,135,485 | 11/1938 | Abbott | 242/35.5 R |
| 2,150,951 | 3/1939 | Toole et al. | 242/18 DD |
| 2,752,100 | 6/1956 | Stange | 242/18 DD |
| 3,044,733 | 7/1962 | Ingham, Jr. et al. | 242/18 DD |
| 3,552,666 | 1/1971 | Stenmans et al. | 242/18 DD X |
| 3,730,448 | 5/1973 | Schippers et al. | 242/43.1 |
| 3,831,869 | 8/1974 | Sartori | 242/18 DD |
| 3,884,426 | 5/1975 | Hermanns | 242/43.1 |
| 3,940,074 | 2/1976 | Laski et al. | 242/18 DD |

FOREIGN PATENT DOCUMENTS 1177212 1/1970 United Kingdom .

*Primary Examiner*—Stanley N. Gilreath

*Attorney, Agent, or Firm*—Oblon, Fisher, Spivak, McClelland & Maier

[57] ABSTRACT

A package mounting arrangement in a textile machine comprises a cradle having a U-shaped form with cradle arms extending from a spine. The cradle arms extend rearwardly of the machine from a pivot axis passing through the arms midway between the spine and package mounting means at the free ends of the arms and disposed at that side of the nip between the package and package driving bowl from which the yarn is fed to the nip in a direction rearwardly of the machine from a traverse mechanism located at the front of the machine. The arrangement provides stability of running, easy access to the package which is presented at the front of the machine for doffing, easy threading of the yarn and easy access to the traverse mechanism for maintainance. The spine forms a handle, a package mass compensating weight, traverse mechanism protection and a support for the operators hand during package doffing.

12 Claims, 4 Drawing Figures

PACKAGE MOUNTING ARRANGEMENT IN A TEXTILE MACHINE

This invention relates to mounting arrangements for packages in textile machines, and in particular, though not exclusively, to arrangements for mounting take-up packages in false twist texturing machinery.

Conventionally in such machines the take-up packages are mounted in two or three vertically spaced rows extending along the length of the machine. Each package is mounted by means of a cradle, the cradles of each row of packages being pivotally mounted on respective pivot shafts having a common axis extending horizontally along the machine, the arms of each cradle extending forwardly of the machine towards the operator's aisle with a package mounted between the free ends of the arms. Each processed yarn is brought, either upwardly or downwardly to the front of the respective package and is led, via a respective traverse mechanism towards the nip between that package and the respective package driving bowl. With such an arrangement, the package cradle pivots as the package grows, with the package itself moving generally upwardly and rearwardly. There is a tendency to produce larger packages for economic reasons, and it is becoming increasingly difficult for an operator to remove large, and therefore heavy, packages from the machines in current use. Furthermore, in reaching into the machine to remove such packages, there is a risk of injury to the operator, and also of damage to the package and to the traverse mechanism, particularly if the package slips from the operator's grasp. To overcome these problems it has been proposed to 'turn the arrangement around'. With such a 'reverse' arrangement the cradle arms extend, from a forwardly disposed pivot shaft, rearwardly into the machine and away from the operator's aisle. Each processed yarn is led via a respective traverse mechanism, towards the nip between the respective package and package driving bow, from the rear of the machine, i.e. that side remote from the operator. Such an arrangement can provide that the growing package pivots towards the operator, and also provides that the traverse mechanism is not in a position in which it is liable to be damaged during doffing of a full package.

However, threading of this machine is more difficult than with the previously described arrangement, as is maintainance of the traverse mechanism, and with either of the arrangements previously described the stability of the cradle during package build is not entirely satisfactory but is maintained at acceptable levels by means of damping mechanisms which are necessary to prevent the package from "bouncing" on the driving bowl.

It is an object of the present invention to provide in a textile machine a package mounting arrangement which avoids or substantially overcomes the disadvantages of the above described arrangements.

The invention provides a package mounting arrangement, in a textile machine having a frame and mounted in said frame a package driving bowl, a cradle and yarn guide means, said cradle comprising a pair of arms between which a package may be mounted to form a nip with said package driving bowl and being pivotal about a pivot axis disposed to that side of said nip from which a yarn is fed thereto from said yarn guide means. Preferably the yarn guide means and the pivot axis are located at the front of said frame and said package driving bowl is located rearwardly thereof, whereby a yarn is fed from the yarn guide means to the nip in a direction rearwardly of the frame.

Said guide means may include a traverse mechanism. A plurality of cradles may be provided in side-by-side disposition in one or a plurality of rows extending lengthwise of the machine. Each cradle in a row of cradles may be mounted to pivot about a common pivot axis but on a respective support structure of said frame. The or each support structure may comprise a pair of spaced cantilevered support arms. The or each cradle may be of U-formation, comprising a spine and a cradle arm at each end thereof, the pivot axis of said cradle on said frame being substantially parallel with said spine and spaced therefrom towards the free ends of said cradle arms. The free end of each cradle arm may be provided with package mounting means adapted to support a package mandrel or tube thereon. Said cradle may be pivotally mounted between said support arms by means of stub axles which are received by aligned cradle pivot means.

Said spine may be positioned relative to said package mounting means and said pivot axis so that said spine is on the same side of the pivot axis as the package mounting means when the cradle is in a start of package build position and moves to the opposite side of the pivot axis therefrom as the cradle moves to a full package position.

At least one of said cradle arms may comprise two parts, a first arm part extending from said spine and having said pivot axis passing therethrough, and a second arm part being pivotally secured to said first arm part and extending to the free end of said one cradle arm. Said second arm part may be resiliently biassed towards the other of said cradle arms whereby said cradle arms are operable to retain a package therebetween, and latching means may be provided to releasably retain said second arm part in a package release position.

The first part of said one cradle arm and the other of said cradle arms may each have a support member for a package mandrel or tube provided thereon, and each support member may be formed having a concave surface directed towards said free ends of said cradle arms.

The package mounting arrangement may also include damping means operable to dampen pivotal oscillations of said cradle about said pivot axis. Said damping means may comprise an arcuate member with which a part of one of said cradle arms is slidably in contact.

The package mounting arrangement may also include feed back means operable to detect the angular disposition of said cradle and to effect changes in the stroke of said traverse mechanism in response to said angular disposition.

Embodiments of a package mounting arrangement in a textile machine will now be described with reference to the accompanying drawings in which.

Figure 1:
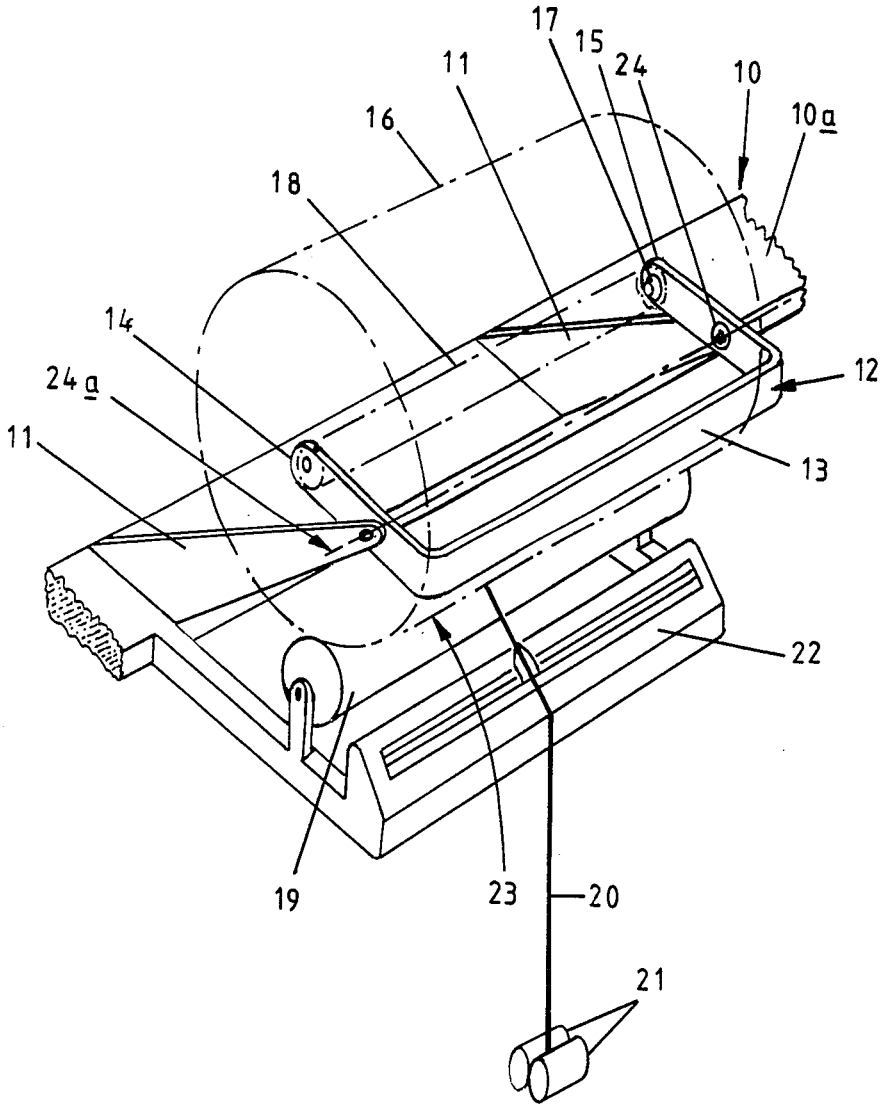
FIG. 1 is a diagrammatic perspective view of a first embodiment from the front of the machine.

Referring now to the drawings there is shown for each embodiment part of a frame 10 of a textile machine, in particular a beam 10*a* running longitudinally of the machine. For each yarn processing station of the machine the beam 10*a* carries a pair of spaced mounting arms 11 at the free ends of which are stub axles 24 providing a pivotal mounting for a cradle 12. Each cradle 12 is of U-shaped configuration comprising a spine 13 and arms 14, 15 extending from spine 13 at the ends thereof. In a textile machine a plurality of cradles 12 are mounted in side-by-side disposition in one of several, for example three rows, each cradle 12 in a row being independently mounted so as to pivot about a common axis 24*a*.

A package 16 is mounted between the free ends of arms 14, 15 there being taper ended or spigotted mountings 17 at the free ends of arms 14, 15 for engagement with the tube 18 of package 16. The package 16 is driven in rotation by package driving bowl 19 and a yarn 20 is fed upwardly, or in alternative arrangements downwardly, at the front of the machine by feed rollers 21 to a traverse mechanism 22 and rearwardly of the machine towards the nip 23 formed by package 16 and package driving bowl 19.

The position of the pivot axis 24*a* of the cradle 12 is forward of the axis of the package driving bowl 19 so that the cradle arms 14, 15 extend generally rearwardly of the machine throughout the range of pivotal movement of the cradle 12 as a package 16 is built on tube 18. As a consequence the cradle 12 pivots during package build so that the axis of package 16 moves generally upwardly of the machine and forwardly thereof.

With the package mounting arrangement of the present invention the completed package is presented very conveniently to the operator in the operators aisle at the front of the machine. Furthermore threading of the machine is readily performed, since the yarn 20 is fed from the feed rollers 21 at the front of the machine to the traverse mechanism 22 and towards the nip 23, in front of which the traverse mechanism 22 is located. Maintainance of the traverse mechanism 22 is also readily performed in view of its accessibility.

The provision of stub axles 24 on which the cradle 12 is mounted allows the cradle pivot axis 24*a* to be located between the spine 13 and the tube mountings 17 at the free ends of arms 14, 15. As a consequence, pivot radius of package 16 is small in comparison with the previously known arrangements in which each cradle is pivoted on a pivot shaft necessarily spaced from the package axis by more than the radius of the full package. Owing to the provision of a relatively small pivot radius, the height of the package 16 when pivoted to the doffing position, shown in FIG. 3 in chain-dotted lines, is kept to a minimum, enabling the height of a machine incorporating two or more rows of package winding mechanisms also to be kept to a minimum. The provision of a small pivot radius also provides that the cradle 12 pivots through a larger angle during package build than is the case with the previously known arrangements having a relatively large pivot radius, and in consequence the package moves nearer to the operator than was the case heretofore. The operator therefore does not have to reach far into the machine to remove the full package which is advantageous from both a safety and an economic point of view.

Figure 2:
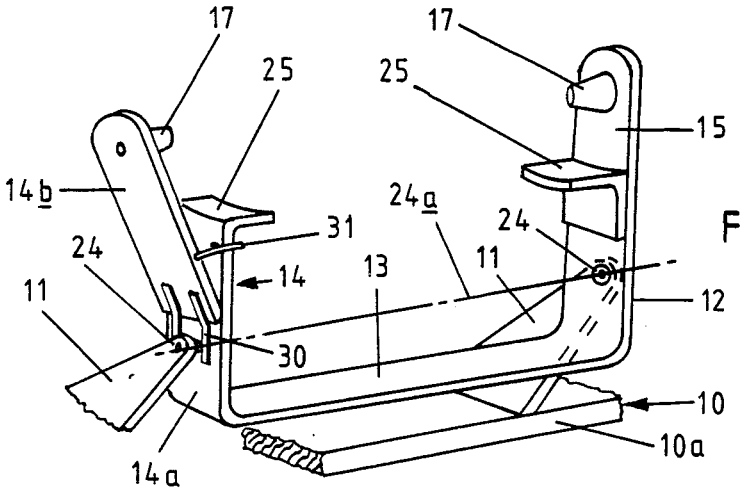
FIG. 2 is a perspective view of the cradle shown in FIG. 1
Figure 3:
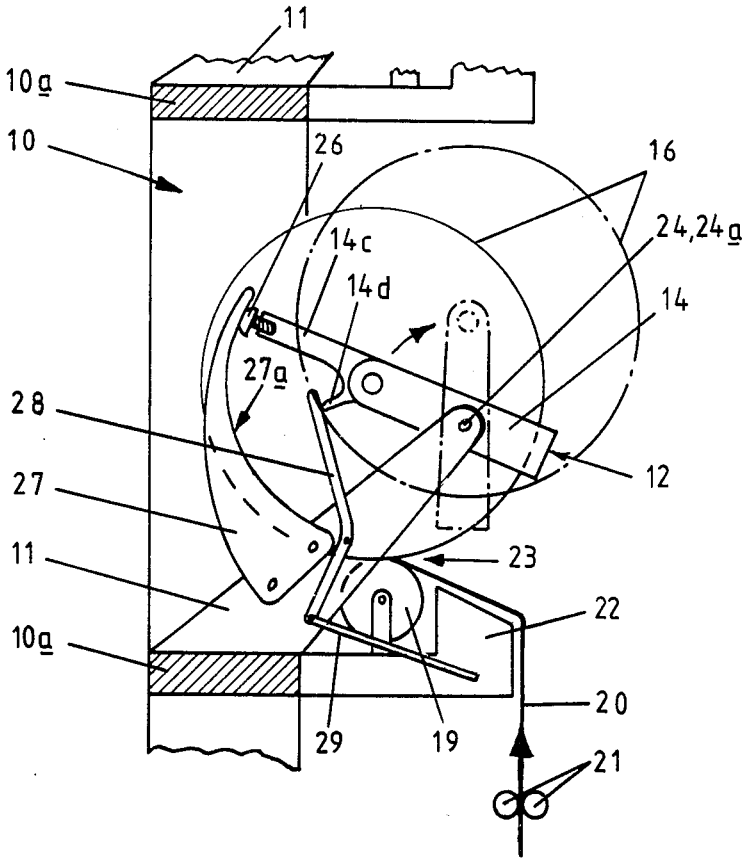
FIG. 3 is an end view showing certain details.

As a further consequence of this arrangement the spine 13 of cradle 12 provides a handle by means of which the cradle 12 is readily pivoted into the package doffing position as shown in FIG. 2 and in chain-dotted lines in FIG. 3. In addition the spine 13, when in this position provides protection for the traverse mechanism 22 and also a support for an operator's hand as he removes the full package 16 from the cradle 12. The spine 13, being on the opposite side of cradle pivot axis 24 from the centre of gravity of package 16 also acts as a balance weight for the package 16 during the pivoting movement of the crade 12 to the doffing position by the operator, thereby reducing the physical effort involved. In addition, in the embodiment of FIG. 4 during package build, the spine 13 moves from a position rearward, ie on the same side as the centre of package 16, of cradle pivot axis 24*a* to one forward, ie on the opposite side to the centre of package 16, thereof, and in doing so its mass tends to counterbalance the growing weight of the package 16. This leads to a more even pressure between package 16 and driving bowl 19 during package build than would be the case if no counterbalancing weight or mechanism were provided, whilst avoiding the need to provide separate mass compensation weights or mechanism for this purpose.

For both embodiments cradle arm 14, 15 is provided with a package support or catching device 25 having a concave surface directed towards the packing mountings 17. Cradle arm 14 is formed in two parts, a fixed part 14*a* which is integral with spine 13 and also carries the cradle pivot bearings for stub axles 24 and the package catching device 25, and a part 14*b* which is pivotally secured to part 14*a* and carries the tube mounting 17. The operation of doffing a full package 16 is as follows. When required the cradle 12 is pivoted, using the spine 13 as a handle, to the doffing position shown in FIG. 2 and in chain-dotted lines in FIG. 3. As the cradle 12 is moved near to this position a package brake (not shown) is automatically applied, bringing the package 16 to rest, and subsequently the cradle 12 is moved into the doffing position shown.

The cradle arm part 14*b* is biassed by springs 30 towards the other cradle arm 15 so as to retain a package 16 between the arms 14, 15. When the cradle 12 is in the package release position the cradle arm part 14*b* is then moved outwardly to release the package 16, which drops a short distance until the tube 18 rests on the catchers 25 If the movement of arm part 14*b* is performed manually it is prevented by a stop from being so moved until the package 16 stops and the cradle 12 is moved into the doffing position. A latch device 31 retains the arm part 14*b* in the package release position. Alternatively a cam device (not shown) may be provided to move arm part 14*b* outwardly automatically as the cradle is moved to the doffing position. In either case arm part 14*b* remains open whilst the package 16 is removed. The spine 13 of cradle 12 acts as a support for the operators hands during this operation and also protects his hands from injury on the traverse mechanism 22 and damage to the traverse mechanism 22 by the package 26. A new tube 18 is placed on the catchers 25 and the cradle 12 is pivoted back towards the operating position. As it is so pivoted the arm part 14*b* is moved, either manually by releasing catch 31 or automatically, back towards the package support postion, the tube mountings 17 engaging the bore of the tube 18 and positioning it thereon automatically. In this way 'threading' of the tube 18 manually onto the mountings 17 is avoided. The shortness of the arm part 14*b*, by comparison with the previously known arrangements in which substantially the whole length of arm 14 is pivotally mounted on spine 13, provides a sturdier construction to the cradle 12.

In order to ensure that the tube 18 is parallel with the package driving bowl 19, and also to facilitate cradle removal for maintainance purposes, the cradle 12 is mounted in self-aligning bearings 34 located in the cradle arms 14,15. One of the bearings 34 is mounted in an eccentric washer 35 which can be rotated in cradle arm 14 so as to raise or lower one end of the cradle 12 relative to the other to align the tube 18 with the package driving bowl 19. At one end of the cradle 12 is a releasable pin (not shown) enabling that end of the cradle to be released from the mounting arm 11. The cradle 12 can then be swivelled about the self-aligning bearing 34 at the other end and readily with-drawn from the machine. This avoids the need for releasable pins being provided at both ends of the cradle 12.

Cradle arm 14 also includes an extension 14*c* in the end of which a spring loaded friction pad 26 is located, see FIG. 3. The friction pad 26 contacts an arcuate member 27 during package build, member 27 being secured to one of the cradle mounting arms 11. This contact provides damping of any oscillation of cradle 12 and package 16 during package build, the damping force being substantially constant throughout the building operation. The contact face 27*a* is substantially circular having its centre on the cradle pivot axis 24*a*. However due to the trailing arm arrangement of the cradle arm 14, 15, i.e. being pivoted from an axis to the same side of the nip 23 as that from which the yarn 20 is fed thereto, better running stability of the package mounting arrangement during package build is achieved than was the case with the leading arm arrangements used heretofore.

In addition cradle arm 14 also includes another extension 14*d* which contacts a pivotally mounted arm 28. Arm 28 is pivotally mounted on cradle mounting arm 11 and is connected by linkage 29 to traverse mechanism 22. As the package 16 grows and cradle 12 pivots in a clockwise direction as seen in FIG. 3, the arm 28 pivots in an anticlockwise and then a clockwise direction, or other desired motion as governed by the shape of arm 28. This motion is transmitted by linkage 29 to the traverse mechanism 22 to reduce the traverse stroke during the middle part of the package build and thereby reduce a straight tapered package 16, counteracting the tendency of the package to bulge due to the pressure of the outer layers on the inner layers.

Figure 4:
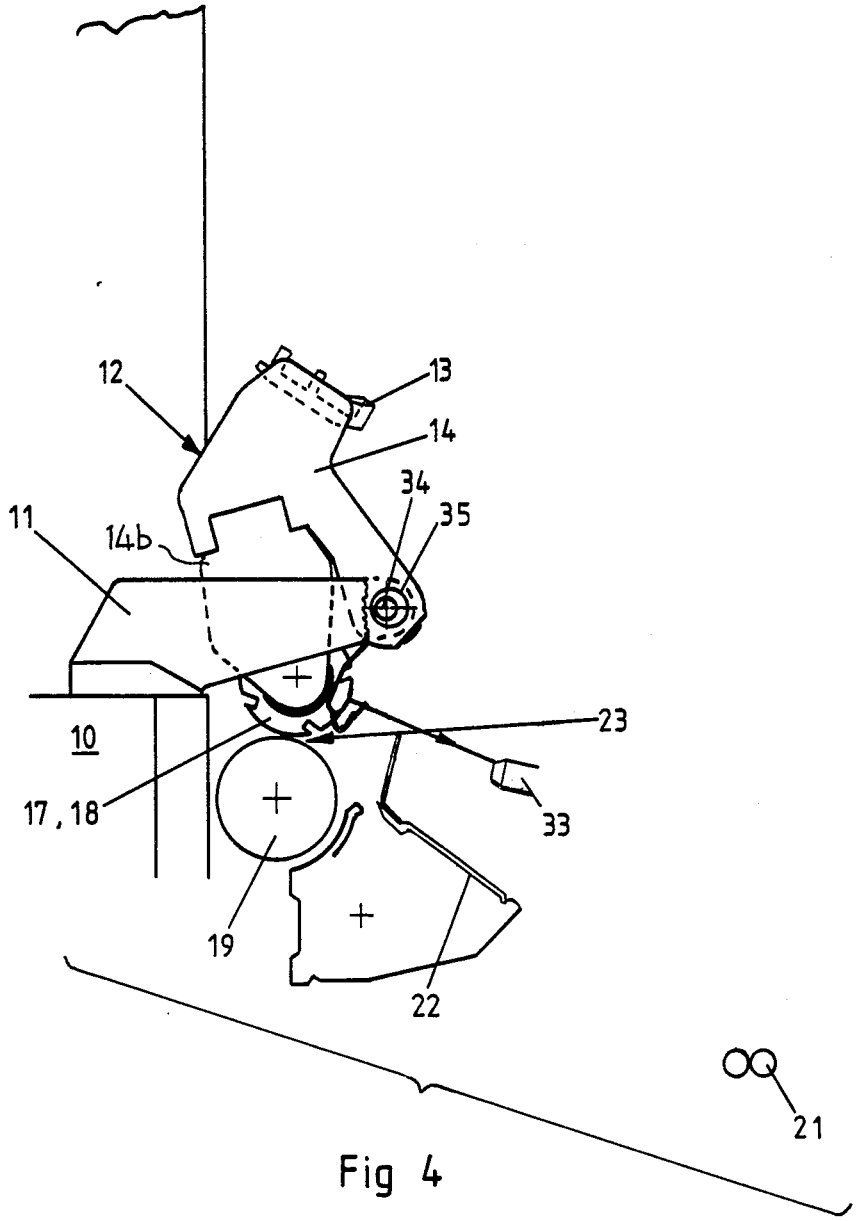
FIG. 4 is an end view showing other details of a second embodiment.

As previously mentioned in relation to the embodiment of FIG. 4, the mass of spine 13 acts as a balance weight for the package 16 during pivoting of the cradle 12 to the doffing position by the operator to reduce the physical effort involved and additional weights can be attached to the spine if required. In previously known arrangements this mass compensation effect has been achieved either by means of weights placed at the ends of arms provided solely for this purpose or by means of spring systems. In the former case additional cost of the machine is incurred and the weights and arms can get in the operators way, and in the latter case there tends to be a considerable amount of friction resisting pivoting of the cradle, particularly as the springs pass through over-centre positions. Arrangements described herein overcome the disadvantages of both of these prior known arrangements. In addition the present arrangements provide increased accessibility compared with both the known arrangements by eliminating separate mass compensation and traverse mechanism protection equipment, thereby allowing for the building of larger packages on an otherwise similar textile machine.

We claim:

1. A package mounting arrangement in a textile machine having a frame, comprising:

a package driving bowl mounted in said frame, a cradle, and yarn guide means, said cradle being of U-shaped formation and comprising a spine having opposed ends and a pair of arms, one of said pair of cradle arms extending from each of said ends of said spine, said arms having free ends and receiving a package therebetween, said free ends being spaced from said spine sufficiently to prevent contact of said package therewith, and said package when mounted between said arms forming a nip with said package driving bowl, said cradle having, and being pivoted about, a pivot axis, wherein said nip extends substantially horizontally in a vertical plane passing therethrough, and wherein said yarn guide means is operable to feed a yarn to said nip from one side of said plane and said pivot axis is disposed to said one side of said plane, and wherein said pivot axis is substantially parallel with said spine, is spaced therefrom towards said free ends of said cradle arms and is defined by at least one cradle pivot means, each said cradle pivot means associated with one respective cradle arm and not extending to another of said cradle arms, whereby said cradle arms are not connected along said pivot axis.

2. A package mounting arrangement according to claim 1 wherein said frame has a front and a rear and said yarn guide means and said pivot axis are located at the front of said frame and said package driving bowl is located rearwardly thereof, whereby a yarn is fed from the yarn guide means to said nip in a direction rearwardly of said frame.

3. A package mounting arrangement according to claim 1 comprising a support structure wherein said cradle is mounted in said support structure which is carried by said frame, said support structure comprising a pair of spaced cantilevered support arms.

4. A package mounting arrangement according to claim 3 comprising a pair of stub axles and aligned cradle pivot means wherein said cradle is pivotally mounted between said support arms by means of said pair of stub axles which are received by said aligned cradle pivot means.

5. A package mounting arrangement according to claim 1 comprising an eccentric washer wherein at least one of said bearings is mounted in said eccentric washer which is rotatably mounted in a respective cradle arm.

6. A package mounting arrangement according to claim 1 wherein the the free end of each cradle arm is provided with package mounting means adapted to support a package mandrel or tube thereon, said cradle being movable between start of package build and full package positions, said spine being positioned relative to said package mounting means and said pivot axis so that said spine is on the same side of said pivot axis as said mounting means when the cradle is in a start of package build position and moves to the opposite side of the pivot axis therefrom as the cradle moves to a full package position.

7. A package mounting arrangement according to claim 6 wherein at least one of said cradle arms comprises two parts, a first arm part extending from said spine and having said pivot axis extending therethrough, and a second arm part being pivotally secured to said first arm part and extending to the free end of said one cradle arm.

8. A package mounting arrangement according to claim 7 including resilient biasing means operable to resiliently bias, said second arm part towards the other of said cradle arms.

9. A package mounting arrangement according to claim 6 comprising a plurality of support members for a package mandrel or tube wherein each cradle arm has a support member provided thereon, each of said support members having a concave surface directed towards said package mounting means at the free end of the respective cradle arm.

10. A package mounting arrangement according to claim 1 comprising damping means operable to dampen oscillations of said cradle about said pivot axis.

11. A package mounting arrangement according to claim 10 wherein said damping means comprises an arcuate member with which a part of said cradle is in sliding engagement.

12. A package mounting arrangement according to claim 1 wherein said guide means comprises a traverse mechanism.

* * * * *